United States Patent [19]

Chern

[11] Patent Number: 4,987,802

[45] Date of Patent: Jan. 29, 1991

[54] POWER WRENCH

[76] Inventor: Shyh Y. Chern, No. 111, Lane 41, Sec. 1, Hsin Jen Rd., Ta Li Hsiang, Taichung Hsien, Taiwan

[21] Appl. No.: 507,368

[22] Filed: Apr. 9, 1990

[51] Int. Cl.[5] ..... B25B 13/46

[52] U.S. Cl. ..... 81/57.39; 81/59.1; 192/45

[58] Field of Search ..... 81/57.39, 59.1; 192/44, 192/45

[56] References Cited

U.S. PATENT DOCUMENTS 3,621,739 11/1971 Seablom ..... 81/59.1
4,051,935 10/1977 Nakayama ..... 81/59.1 X
4,603,606 8/1986 Headen ..... 81/59.1
4,722,252 2/1988 Fulcher et al. ..... 81/57.39

*Primary Examiner*—James G. Smith
*Attorney, Agent, or Firm*—Steinberg & Raskin

[57] ABSTRACT

A power wrench includes a socket which is rotatably retained in a head portion of the wrench by a retainer. A yoke is actuated to swing by a driving axle. A number of grooves are formed in the yoke and in the retainer, each groove gradually changes from narrow to wide and receives a roller and a spring. The rollers slidably contact the socket. When the yoke rotates in one direction, the socket is actuated to rotate. When the yoke rotates in a reverse direction, the rollers in the retainer are caused to hold the socket and prevent the socket from backlash.

2 Claims, 5 Drawing Sheets

POWER WRENCH

BACKGROUND OF THE INVENTION

The present invention relates to a wrench, and more particularly to a power wrench.

A power wrench which is driven by bearing member is disclosed in U.S. Pat. No. 4,603,606 to Headen. A yoke 72 is actuated to rotate with a reciprocating arcuate motion by a rotation of a drive shaft 86 via a pivot ball 80, as shown in FIG. 6 of this patent. The cartridge 10 is driven by the arcuate motion of the yoke 72, and the shaft 16 is driven to rotate by the roller bearing 18. The shaft 16 should be stably held in position by a retaining force in order to prevent the shaft 16 from "backlash" when the core 20 of the cartridge 10 rotates backward. The retaining foce should be overcome by the power driving the drive shaft 86. The efficiency thereof is increased on the order of 30% which is unsatisfactory.

The present ivnention has arisen to mitigate and/or obviate the afore-described disadvantages of the conventional power wrench.

SUMMARY OF THE INVENTION

The primary objective of the present invention is to provide a power wrench which conserves energy and has an excellent efficiency.

In accordance with one aspect of the invention, there is provided a power wrench which includes a yoke rotatably supported on a socket. The socket is rotatably retained in a head portion of the wrench by a retainer. The yoke is actuated to make a reciprocating arcuate motion by a driving axle. A number of grooves are formed in the yoke, each groove gradually changes from narrow to wide and receives a roller and a spring. One or more grooves are formed in the retainer, the groove also gradually changes from narrow to wide and receives a roller and a spring. The rollers slidably contact the socket. When the yoke rotates in one direction, the socket is actuated to rotate. When the yoke rotates in a reverse direction, the rollers in the retainer are caused to hold the socket and prevent the socket from backlash.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
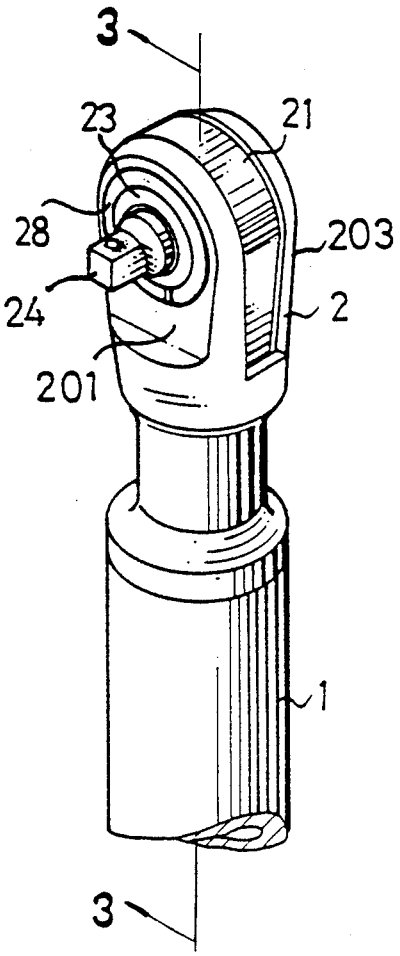
FIG. 1 is a perspective view of a power wrench in accordance with the present invention.
Figure 2:
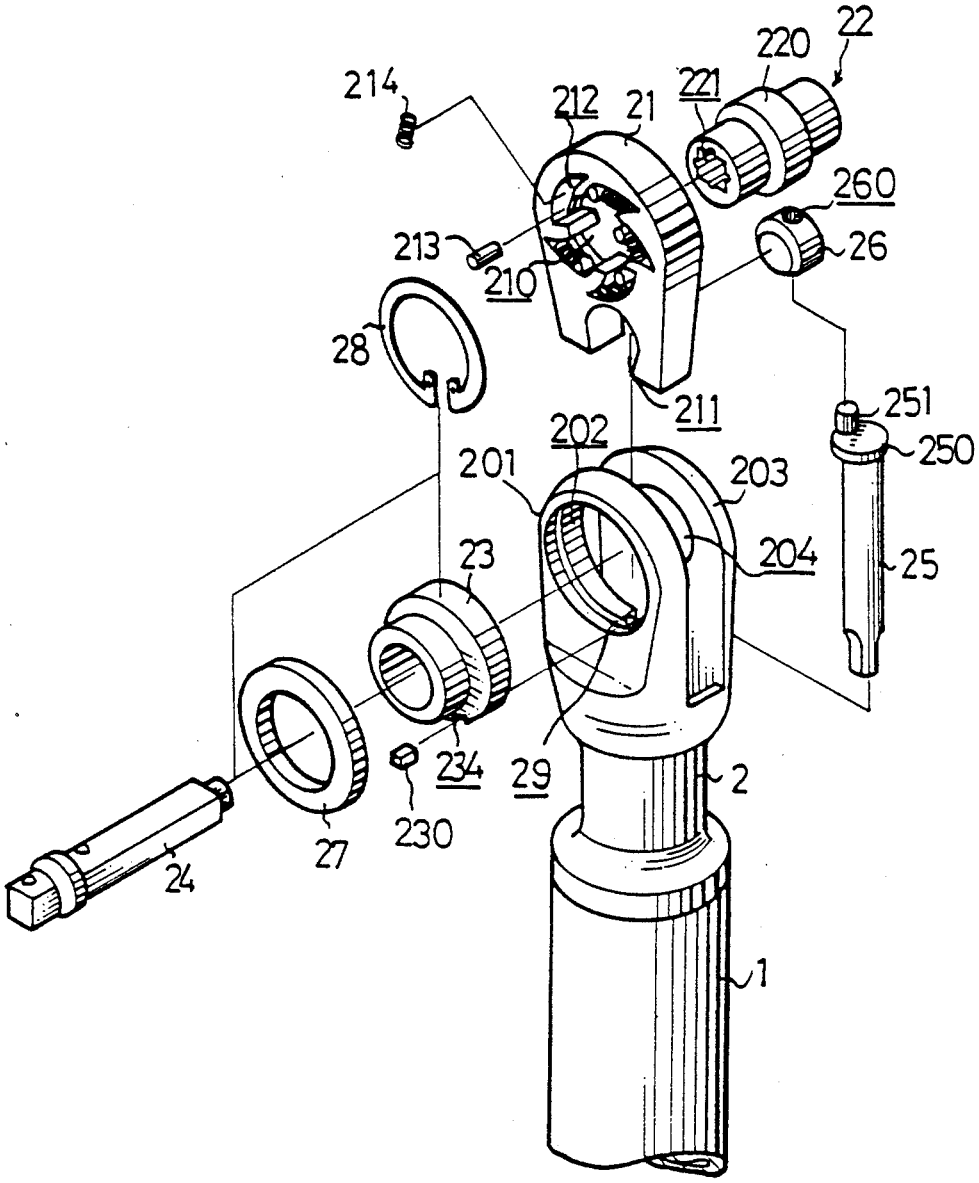
FIG. 2 is an exploded view of the power wrench.
Figure 3:
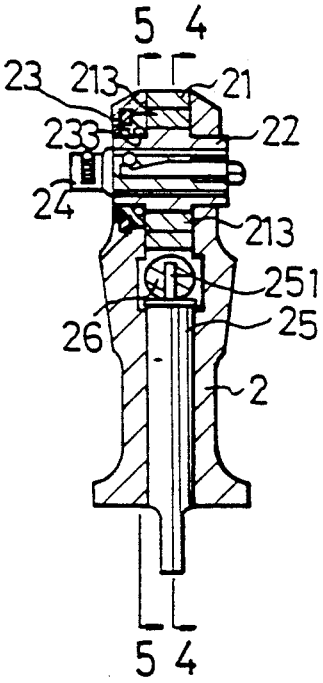
FIG. 3 is a cross sectional view taken along lines 3—3 of FIG. 1.

Referring to the drawings and initially to FIGS. 1, 2 and 3, the power wrench in accordance with the present invention comprises generally a head portion 2 and a handle portion 1 extending therefrom.

Two lugs 201, 203, each having a circular opening 202, 204, are integrally formed on an upper end of the head portion 2 and face each other. The diameter of the opening 202 is larger than that of the opening 204. A notch 29 is formed in the lug 201. A yoke 21 which has an aperture 210 is received in the head portion 2 between the lugs 201, 203. A cavity 211 is formed in a neck portion of the yoke 2 for receiving a pivot ball 26. The pivot ball 26 which has a hole 260 is adapted to mount on a rotatable eccentric driving axle 25 having an enlarged collar poriton 250 disposed thereupon. A pin 251 is integrally fixed on the collar portion 250 and is engaged in the hole 260 of the pivot ball 26. a rotation of the eccentric driving axle 25 produces a reciprocating arcuate motion of the yoke 21, this is well known in the art.

Figure 4:
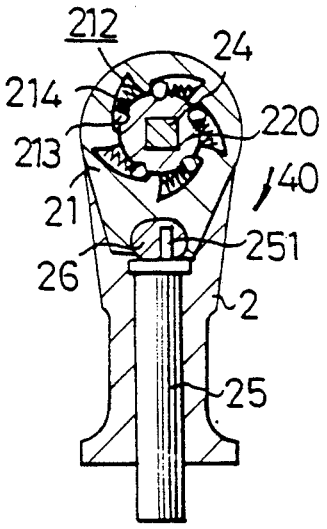
FIG. 4 is a cross sectional view taken along lines 4—4 of FIG. 3.

Five grooves 212 are formed in the yoke 21 around the aperture 210 thereof. A ball or a roller 213 and a spring element 214 are received in each groove 212. Each groove 212 gradually changes, clockwise, from narrow to wide, as shown in FIG. 4. Each roller 213 is disposed in the narrower end of a respective groove 212. A socket 22 has a rectangular hole 221 for receiving a drive shaft 24. A ring portion 220 is formed in a center of the socket 22 and is received in the aperture 210 of the yoke 21. The rollers 213 slidably contact the outer peripheral surface of the ring portion 220. a retainer 23 which has a notch 234 aligned with the notch 29 of the lug 201 is received in the opening 202 of the lug 201. A key 230 is engaged in the notches 29 and 234 so that the retainer 23 is not rotatable relative to the head portion 2. The retainer 23 is further retained in place by a washer 27 and a retaining ring 28. The retainer 23 exerts no force to the socket 22, and the ring portion 220 of the socket 22 is limited to a rotational movement by the lug 203 and the retainer 23 so that the socket 22 is freely rotatable in the head portion 2.

Figure 5:
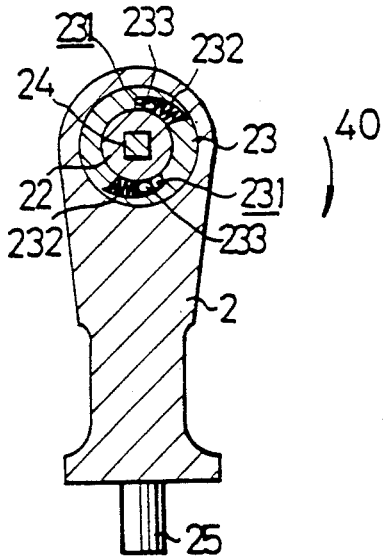
FIG. 5 is a cross sectional view taken along lines 5—5 of FIG. 3.

As is best shown in FIG. 5, two grooves 231 are formed in the inner surface of the retainer 23. A spring 232 and a roller or ball 233 are provided in each groove 231. Each groove 231 gradually changes, clockwise, from narrow to wide. Each roller 233 is disposed in the narrower end of a respective groove 231.

Referrin next to FIG. 4, when the yoke 21 is actuated by the driving axle 25 to rotated in the direction as indicated by the arrow 40, the rollers 213 relatively slide further toward the narrow end of the grooves 212 so that the ring portion 220 of the socket 22 is clamped by the rollers 213 and so that the socket 22 is caused to rotate in the direction of the arrow 40. When the socket 22 and the drive shaft 24 are driven to rotate in the direction of the arrow 40, referring next to FIG. 5, the rollers 233 within the retainer 23 are caused to move toward the wider end of the grooves 231 so that the socket 22 will not be clamped by the rollers 233.

Figure 6:
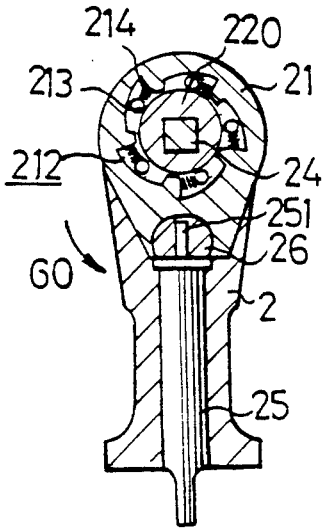
FIG. 6 is a cross sectional view similar to FIG. 4, illustrating a working position of the wrench.
Figure 7:
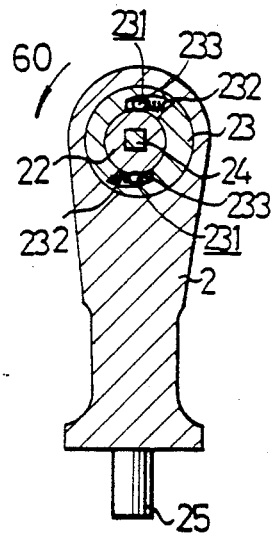
FIG. 7 is a cross sectional view similar to FIG. 5, illustrating a working position of the wrench.

Referring next to FIG. 6, when the yoke 21 is actuated by the driving axle 25 to rotate in the direction as indicated by the arrow 60, the rollers 213 are caused to slide relatively toward the wider end of the grooves 212 so that the ring portion 220 of the socket 22 will not be clamped by the rollers 213. At this moment, referring next to FIG. 7, the socket 22 and the drive shzft 24 have a tendency to rotate in the direction of the arrow 60 so that the rollers 233 within the retainer 23 have a tendency to move toward the narower end of the grooves 231. In this direction, the socket 22 will be clamped by the rollers 233 so that the socket 22 can not rotate in the direction of the arrow 60. It is to be noted that the force required to prevent the socket 22 from backlash is small, only one roller 233 is enough to prevent the socket 22 from rotating backwards. It is also to be noted that there is no force applied to the yoke 21 when the yoke 21 rotates rearward along the direction of the arrow 60 so that the yoke 21 may freely rotate backwards. Accordingly, the driving axle 25 does not need to overcome additional forces applied to the yoke 21 and/or the socket 22 so that energy is conserved.

Since the socket 22 and the drive shaft 24 are active in the direction of 40 only, it is preferable that the drive shaft 24 can be reversed relative to the socket 22 so that the drive shaft 24 is active in the direction of 60. This is solved as described below.

Figure 8:
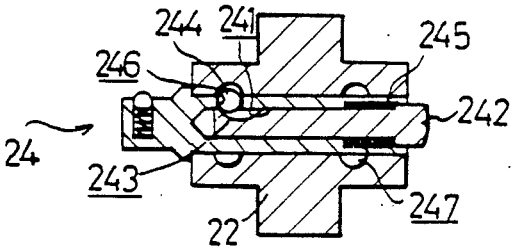
FIG. 8 is a cross sectional view of the drive shaft of the power wrench.
Figure 9:
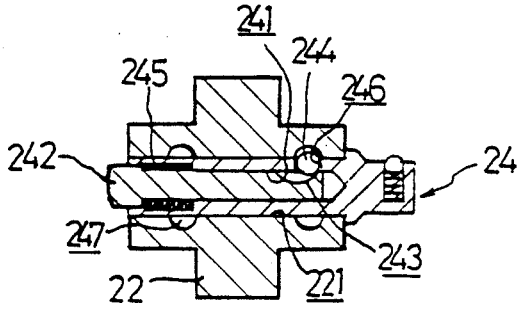
FIG. 9 is a cross sectional view similar to FIG. 8, illustrating the drive shaft in a reverse direction.
Figure 5:
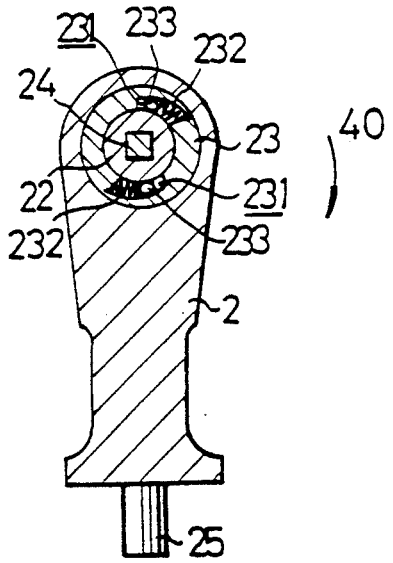
Figure 6:
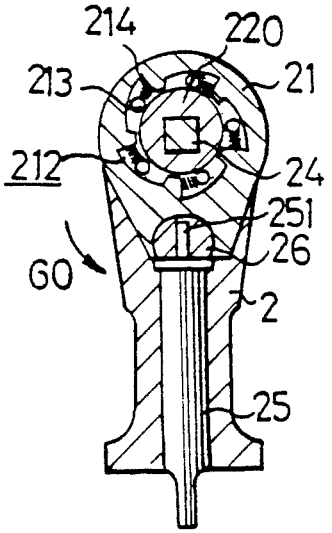
Figure 7:
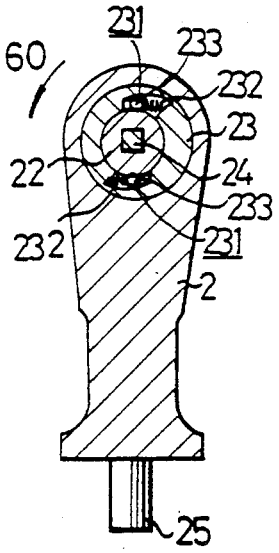
Figure 8:
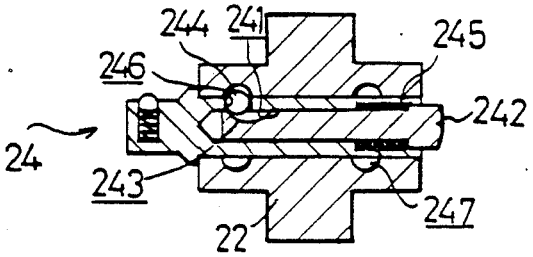
Figure 9:
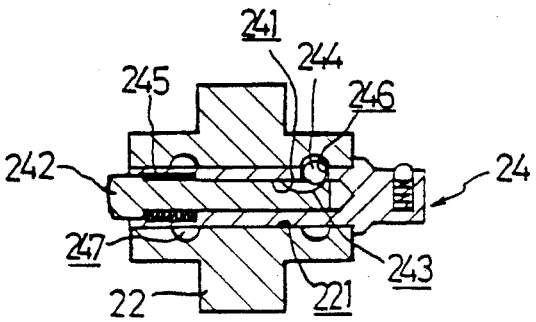

Referring next to FIGS. 8 and 9, a hole 241 is formed in the rear end of the drive shaft 24 for receiving a button 242. A depression 243 is formed in a front end of the button 242. A puncture 246 is formed in the middle portion of the drive shaft 24. A ball 246 is received within the depression 243 and the puncture 246. Two spring elements 245 are provided between the button 242 and the drive shaft 24 and bias the button 242 rearward relative to the drive shaft 24. Four recesses 247 are formed in the inner surface of the socket 22. When the button 242 is biased rearward relative to the drive shaft 24, the ball 244 is pushed upward by the depression 243 to engage with one of the recesses 247 so that the drive shaft 24 is retained in position, as shown in FIG. 8. When it is desired to remove the drive shaft 24 from the socket 22, it is only required to press the button 242 so that the ball 244 drops into the depression 243. When the drive shaft 24 is reversely fitted into the socket 22, the ball 244 will be depressed downward by the inner surface of the socket 22 until the ball 244 is engaged with a respective recess 247. Therefore, the drive shaft 24 can be easily reversed.

Since there is no additional force applied to the yoke 21 when the yoke 21 is not rotated in an active direction, there is no need for the driving axle 25 to spend additional energy to overcome additional forces. Accordingly, the power wrench in accordance with the present invention conserves energy. The efficiency thereof is greatly increased.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A power wrench comprising generally a head portion and a handle portion extending therefrom, two lugs, each having an opening, being integrally formed on one end of said head portion, a socket being rotatably supported between said lugs by one of said lugs and a retainer which is disposed in said opening of an other lug, said retainer which has a center hole substantially embracing one end of said socket, a drive shaft being received in said socket; a yoke which has an aperture being rotatably supported on a substantially intermediate portion of said socket, a cavity being formed in a neck portion of said yoke, a pivot ball being disposed eccentrically on an upper end of a driving axle and being slidably received within said cavity of said yoke, said neck portion of said yoke being actuated to make a reciprocating arcuate motion by said driving axle, characterized in that a plurality of first grooves are formed around said aperture of said yoke, each said first groove gradually changes from narrow to wide; a first roller and a first spring are disposed within each said first groove, in which said first roller is located closer to a narrower end of said first groove, said first rollers slidably contact said intermediate portion of said socket; at least one second groove is formed around said·center hole of said retainer, said second groove gradually changes, in a direction similar to that of said first groove, from narrow to wide; a second roller and a second spring are received in each said second groove, said second roller slidably contact said one end of said socket; when said yoke rotates in one direction so that said first rollers are caused to move toward said narrower ends of said first grooves, said first rollers cause said socket to rotate; and when said yoke rotates in a reverse direction, said second roller is caused to hold said socket and prevent said socket from backlash, and said first rollers are caused to mvoe toward a wider end of each said first groove so that said yoke can freely rotate backwards.

2. A power wrench according to claim 1, wherein a hole is formed in a rear end of said drive shaft for receiving a button therein, a depression is formed in an inner end of said button, a spring element is disposed between said drive shaft and said button and biases said button rearward relative to said drive shaft, a puncture is formed in said drive shaft and substantially aligned with said depression of said button, a plurality of recesses are formed in an inner surface of said socket, and a ball is received in said depression of said button and said puncture of said drive shaft, said ball is pushed outward of said drive shaft by said button to engage one of said recesses of said socket, and said ball drops into said depression when said button is depressed.

* * * * *